United States Patent [19]

Schmidt

[11] Patent Number: 4,691,136

[45] Date of Patent: Sep. 1, 1987

[54] INSULATOR ASSEMBLY FOR ELECTRODE OF PIEZOELECTRIC IGNITION DEVICE

[75] Inventor: Frank T. Schmidt, Mulvane, Kans.

[73] Assignee: The Coleman Company, Inc., Wichita, Kans.

[21] Appl. No.: 946,879

[22] Filed: Dec. 29, 1986

[51] Int. Cl.[4] ..... H01L 41/08; F23Q 3/01

[52] U.S. Cl. ..... 310/339; 431/255

[58] Field of Search ..... 310/339; 361/260; 431/255, 258, 263, 264, 132

[56] References Cited

U.S. PATENT DOCUMENTS 3,436,164 4/1969 Deucher ..... 431/255

3,741,714 6/1973 Yoshinaga ..... 431/255

*Primary Examiner*—Mark O. Budd

[57] ABSTRACT

An insulator assembly for a piezoelectric ignition device includes a Teflon sleeve which surrounds the electrode of the ignition device, a ceramic insulator tube which surrounds the Teflon sleeve, and flexible silicone sealing material between the insulator tube and the piezoelectric crystal and between the insulator tube and the casing for the crystal.

9 Claims, 10 Drawing Figures

FIG. 5
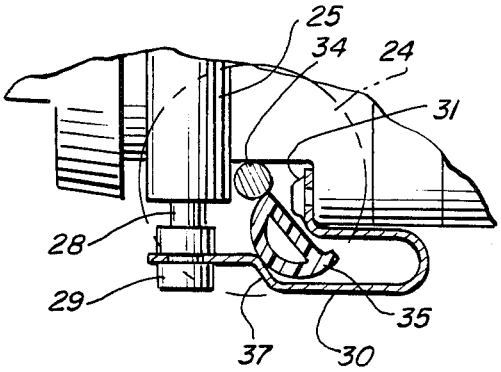
FIG. 6
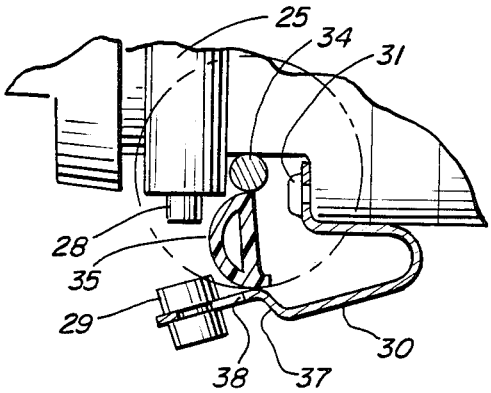
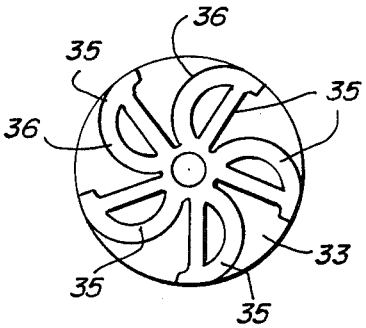
FIG. 7
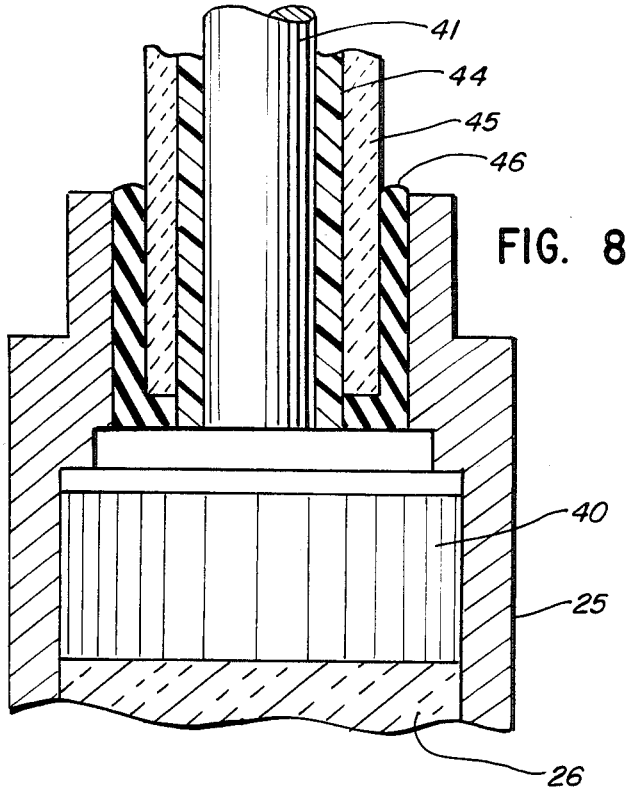
FIG. 8
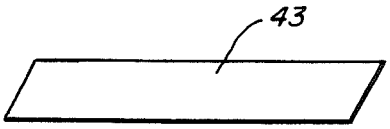
FIG. 9
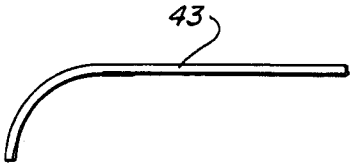
FIG. 10

INSULATOR ASSEMBLY FOR ELECTRODE OF PIEZOELECTRIC IGNITION DEVICE

BACKGROUND

This invention relates to piezoelectric ignition devices, and, more particularly, to an insulator assembly for an electric conductor of a piezoelectric ignition device.

Piezoelectric ignition devices are commonly used for igniting propane lanterns, barbecue grills, etc. A piezoelectric ignition device generally includes a piezoelectric crystal, an impact hammer for striking the crystal, and an electrode for conducting voltage from the crystal to the point of ignition. The outer and of the electrode is spaced from a grounded conductor. The piezoelectric crystal generates a voltage when it is impacted by the hammer, and propane or other fuel is ignited when the piezoelectric electrode arcs to ground.

The electrode for the piezoelectric crystal must be insulated from adjacent grounded metal other than the ground at the point of ignition. The ignition device is subjected to severe mechanical shock loads each time the device is activated, and the insulator is also subjected to mechanical shock loads by the impact hammer. The insulator should therefore be capable of withstanding continual shocks over a long period of time. Since the insulator is located near a flame, the insulator should be flame-resistant. Many piezoelectric ignition devices are used outdoors, and the insulator must be able to withstand 100% moisture and severe cold.

One type of insulator which has been used is a molded insulator tube of dielectric refractory material such as ceramic. The insulator tube surrounds the conductor and insulates it from adjacent metal. However, such refractory tubes are brittle and are subject to cracking under repeated mechanical shocks. Shocks can be transmitted directly from the crystal to the insulator, or radial shocks can be transmitted to the insulator by the electrode. Once the insulator tube cracks, the conductor can arc to ground through the crack.

Another insulator which has been used is a Teflon sleeve which surrounds the insulator. However, a Teflon sleeve will melt under direct flame or near-flame conditions.

One type of prior art lantern isolates the insulator and the electrode from shock by mounting the piezoelectric crystal remotely from the flame and connecting the electrode to the crystal with a wire lead. This assembly is very expensive to install.

U.S. Pat. No. 4,051,396 describes a piezoelectric device in which the piezoelectric crystal is surrounded by an insulating bushing, and the crystal and the bushing are encapsulated with an insulating viscous fluid such as epoxy resin without hardener.

SUMMARY OF THE INVENTION

The invention provides an insulating assembly which is relatively inexpensive yet which provides high dielectric strength under the most severe operating conditions of high shock loading, direct flame impingement, 100% moisture, and below 0° F. cold. A thin-wall Teflon sleeve surrounds the electrode, and a dielectric insulator tube of refractory material surrounds the Teflon sleeve. Both the Teflon sleeve and the insulator tube extend into a recess in the housing which holds the dielectric crystal, and a flexible sealing material such as silicone sealant fills the space between the insulator tube and the housing and separates the bottom of the tube from the crsytal. The sealing material provides a moisture barrier to prevent arcing and isolates the insulator tube from the mechanical shocks which are imparted to the crystal. The Teflon sleeve acts as a radial shock sleeve and prevents shocks from being transmitted from the electrode to the insulator tube. If the flame impinges directly on the insulator assembly, the Teflon sleeve will melt and fill the area between the electrode and the insulator tube. This is a self-protecting feature which seals the insulator assembly from further damage and does not reduce the dielectric capacity of the insulator assembly.

DESCRIPTION OF THE DRAWING

The invention will be explained in conjunction with an illustrative embodiment shown in the accompanying drawing, in which

FIG. 5 is a fragmentary sectional view of the bottom of the ignition device showing the impact hammer and the actuating knob;

FIG. 6 is a view similar to FIG. 5 showing the impact hammer being forced away from the piezoelectric crystal by the actuator knob;

FIG. 7 is an elevational view of the actuator knob;

FIG. 8 is an enlarged fragmentary sectional view of the upper portion of the piezoelectric crystal;

FIG. 9 is an elevational view of the igniter tab; and

FIG. 10 is a top plan view of the igniter tab.

DESCRIPTION OF SPECIFIC EMBODIMENT

Figure 1:
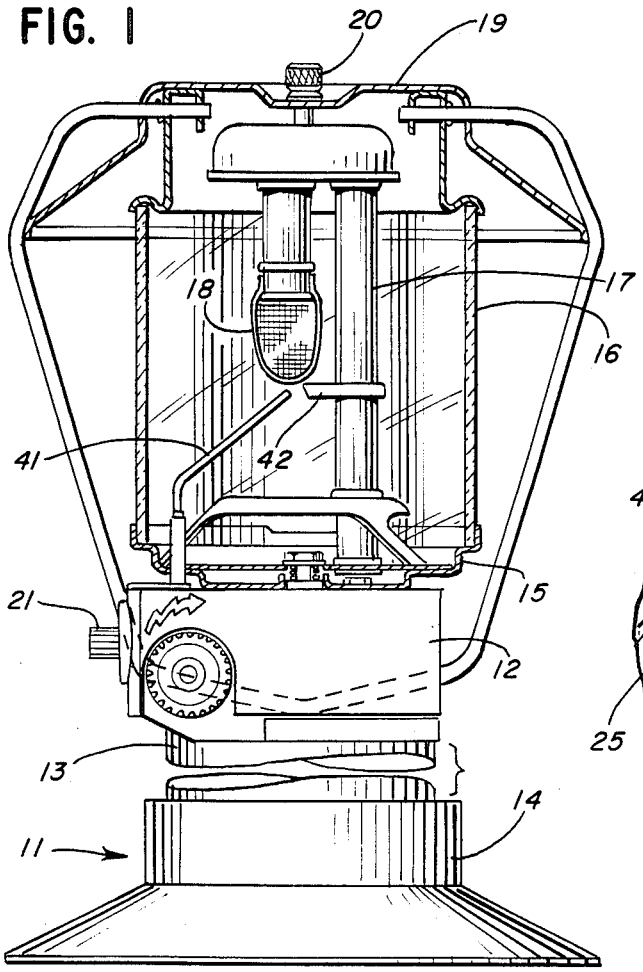
FIG. 1 is an elevational view, partially broken away, of a propane lantern equipped with a piezoelectric ignition device and an insulating assembly in accordance with the invention.

The invention will be explained in conjunction with a propane lantern 11 illustrated in FIG. 1. It will be understood, however, that the invention can be used with any device which is equipped with a piezoelectric ignition device. The lantern 11 is conventional except for the piezoelectric ignition device, and a detailed explanation of the lantern is unnecessary.

The lantern includes a base 12 which is supported by a propane tank 13, and the tank is mounted in a support collar 14. A dish-shaped pan 15 is mounted on the base 12 and supports a cylindrical globe 16. A burner assembly 17 extends upwardly within the globe and conducts fuel from the propane tank 13 to a catalytic mantle 18. A ventilator cover 19 is mounted on top of the globe and is secured to the burner assembly by a nut 20. Fuel flow is controlled by a valve (not shown) in the base of the lantern, and the valve is operated by a control knob 21.

Figure 2:
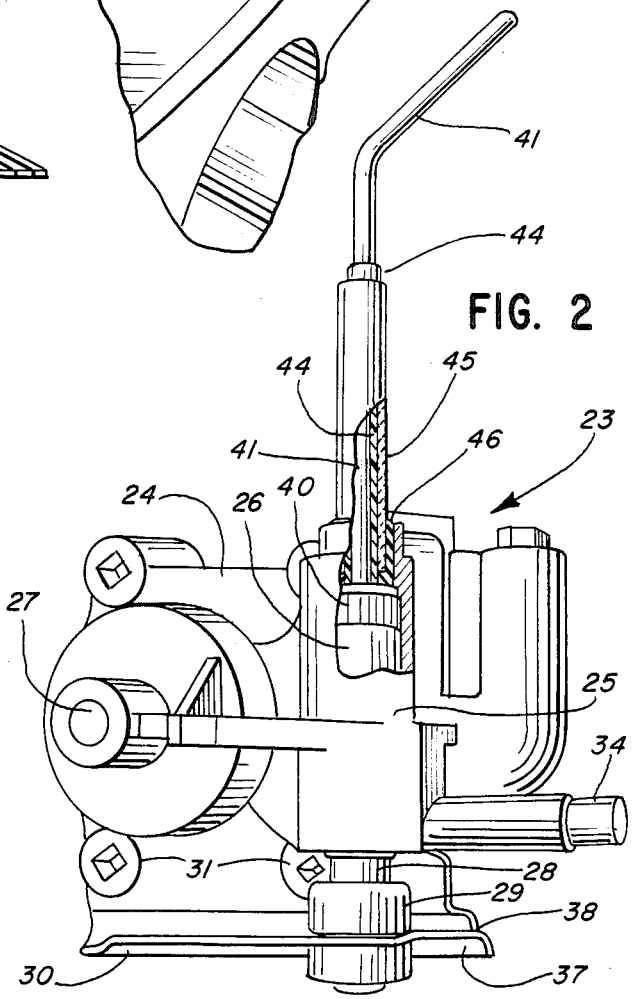
FIG. 2 is a fragmentary lower perspective view, partially broken away, of the ignition device.

Referring now to FIG. 2, a piezoelectric ignition device 23 is mounted within the base 12 of the lantern. Except for the insulator assembly which will be described hereinafter, the ignition device is conventional and can take the form of the ignition device described in U.S. Pat. No. 4,051,396.

The ignition device includes a support plate 24 and a generally cylindrical housing 25 which encloses a conventional piezoelectric crystal 26. The support plate 24 and the housing 25 are molded integrally from insulating material such as glass-filled nylon or other plastic. The support plate is provided with a bore 27 through which the control shaft for the fuel valve extends. An impact pin 28 extends downwardly from the lower end of the crystal through an opening in the housing 25. An impact hammer 29 is mounted below the impact pin 28 for striking the pin and subjecting the crystal to compressive loads. The impact hammer is mounted on a U-shaped metal spring plate 30 (see also FIGS. 5 and 6) which is attached to the support plate by screws 31.

The impact hammer 29 is activated by a cam knob 33 which is rotatably mounted on a shaft 34 which is molded with the support plate 24 and housing 25. The cam knob has five cams 35 (FIG. 7), and each cam has a generally semicylindrical camming surface 36. FIG. 5 shows the position of one of the cams 35 before the hammer is actuated. The cam is adjacent a shoulder 37 in the spring plate 30. The hammer is actuated by rotating the camming knob clockwise in FIGS. 5 and 6. The spring plate 30 is forced downwardly by the cam 35 until the cam passes the shoulder 37. The spring plate is provided with a recess 38 (FIG. 2) beyond the shoulder which allows the spring plate to snap back to its original position. The hammer thereby strikes the impact pin 28 and compresses the crystal.

A metal anvil 40 is mounted in the housing 25 above the crystal 26. A metal electrode 41 is silver soldered to the top of the anvil and extends upwardly through an opening 42 (FIG. 4) in the top of the housing 25. The electrode terminates near the mantle 18 (FIG. 1) and is spaced from a metal igniter tab 43 which is welded to the metal burner assembly 17. The igniter tab acts as a grounded electrode, and the space between the igniter tab and the electrode provides a spark gap. When the piezoelectric crystal is impacted by the hammer, voltage is conducted from the crystal by the electrode and arcs to the igniter tab, thereby igniting the propane fuel which is delivered to the mantle by the burner assembly.

Figure 4:
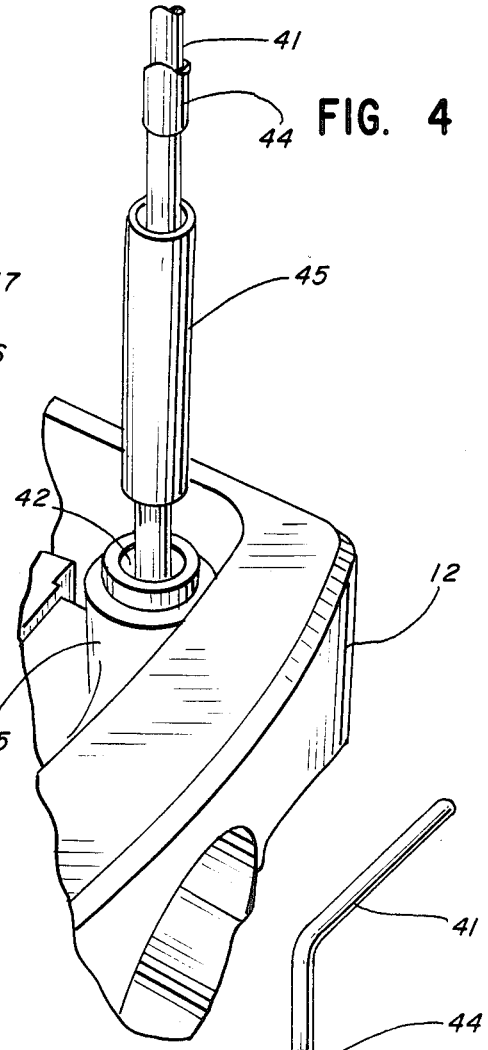
FIG. 4 is a view similar to FIG. 3 showing the parts of the insulator assembly.
Figure 3:
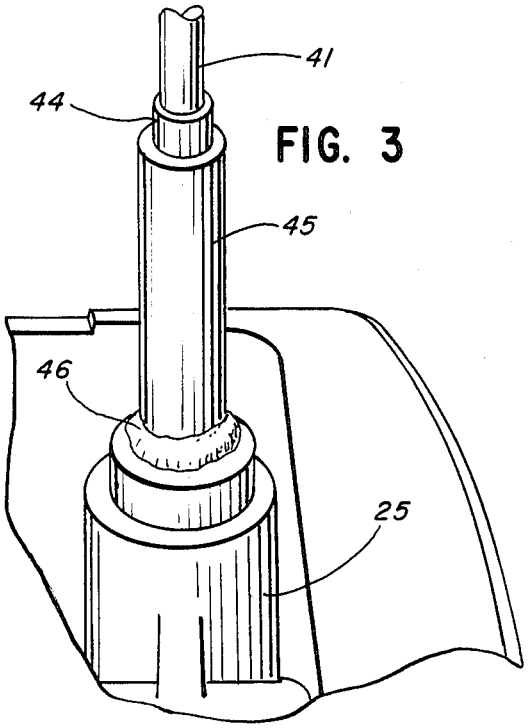
FIG. 3 is a fragmentary upper perspective view, partially broken away, of the ignition device.

Referring to FIGS. 2, 4, and 8, the opening 42 in the housing 25 is larger than the electrode 41, and the housing provides an annular recess or cavity above the anvil 40 and around the electrode 41. A thin-walled Teflon sleeve 44 surrounds the electrode and extends into the housing and contacts the anvil 40. A ceramic insulator tube 45 surrounds the Teflon sleeve 44 and also extends into the housing. Before the ceramic insulator tube is inserted into the housing, silicone sealant or sealastic 46 is deposited in the recess in the housing around the Teflon sleeve. The ceramic insulator tube is then inserted into the housing and rotated one full turn to spread the silicone sealant throughout the recess. Some of the sealant is forced out of the housing as illustrated in FIG. 3.

The silicone sealant is a conventional RTV self-leveling type of sealant. One specific sealant that has been used is Hylomar RTV No. 121 or 123 available from Marston Bentley of Rochester, Minnesota. The cured sealant or sealastic remains flexible and provides a resilient shock mounting between the top of the crystal and the bottom of the ceramic insulator 45. The sealant also fills the recess in housing 25 and provides a moisture barrier to prevent water from entering the housing and shorting the electrode.

The thin-walled Teflon sleeve 44 is flexible and resilient and acts as a radial shock sleeve for the brittle ceramic insulator tube 45. The Teflon sleeve absorbs shocks which are transmitted by the electrode 41 and protects the ceramic tube from cracking.

In one specific embodiment of the invention the Teflon sleeve 44 had an inside diameter of $0.107 \pm 0.005$ inch and a wall thickness of $0.008 \pm 0.002$ inch. The wall thickness was therefore no greater than 1/10 of the inside diameter. The ceramic insulator tube was formed from 99% alumina and had an inside diameter of $0.125 \pm 0.005$ inch and an outside diameter of $0.187 \pm 0.005$ inch.

Although Teflon is the preferred material for the shock sleeve 44, other resilient and flexible plastics or other insulating materials can be used. Similarly, other refractory materials of satisfactory dielectric strength can be used for the insulator tube 45.

The ceramic insulator tube 45 is flame-resistant and is not harmed if the flame impinges on it. However, the Teflon shock sleeve 44 will melt in the event of direct flame impingement. If the Teflon sleeve melts, it will simply flow into the annular space between the electrode 41 and the ceramic insulator tube 45. The melted Teflon material is retained in the annular space by the silicone sealant material 46 and seals the insulator assembly from further damage. When the Teflon rehardens, it regains its shock-abosrbing characteristics. The insulator assembly retains its dielectric strength and can continue to perform satisfactorily.

While in the foregoing specification a detailed description of a specific embodiment of the invention was set forth for the purpose of illustration, it will be understood that many of the details herein given may be varied considerably by those skilled in the art without departing from the spirit and scope of the invention.

I claim:

1. In a piezoelectric ignition device having a piezoelectric crystal, a housing surrounding the crystal, and an electrode attached to the crystal and extending outwardly from the housing, an insulator assembly comprising a plastic sleeve surrounding the electrode, a tubular dielectric insulator surrounding the plastic sleeve, and a flexible sealing material between the crystal and the insulator.

2. The structure of claim 1 in which the plastic sleeve is Teflon.

3. The structure of claim 1 in which the insulator is ceramic material.

4. The structure of claim 1 in which the sealing material is silicone sealant.

5. The structure of claim 1 in which the plastic sleeve has a wall thickness of about 1/10 or less of the inside diameter of the sleeve whereby the sleeve is relatively flexible.

6. The structure of claim 5 in which the plastic sleeve is Teflon.

7. The structure of claim 1 in which the sealing material is also positioned between the insulator and the housing.

8. The structure of claim 1 in which the housing provides a recess through which the electrode extends, the outside surface of the insulator being spaced from the inside surface of the recess, and the sealing material filling the space between the insulator and inside surface of the recess.

9. In a piezoelectric ignition device having a piezoelectric crystal, a housing surrounding the crystal, and an electrode attached to the crystal and extending outwardly from the housing, an insulator assembly comprising a thin-walled flexible insulating sleeve surrounding the electrode, a tubular dielectric insulator surrounding the thin-walled sleeve, and a flexible sealing material between the crystal and the insulator.

* * * * *